United States Patent [19]

Lehmann et al.

[11] Patent Number: 4,608,844

[45] Date of Patent: Sep. 2, 1986

[54] CRADLE STRAIGHTENER FEEDER

[75] Inventors: Werner K. Lehmann, Birmingham; Robert E. Lamey, Southfield; Karl Lehmann, Dearborn Heights, all of Mich.

[73] Assignee: Sesco, Inc., Detroit, Mich.

[21] Appl. No.: 671,861

[22] Filed: Nov. 15, 1984

Related U.S. Application Data

[63] Continuation of Ser. No. 323,830, Nov. 23, 1981, Pat. No. 4,487,045.

[51] Int. Cl.[4] ..... B21C 47/22

[52] U.S. Cl. ..... 72/43; 72/183; 242/78.8

[58] Field of Search ..... 72/183, 43; 242/78.6, 242/78.7, 78.8; 248/656, 669

[56] References Cited

U.S. PATENT DOCUMENTS

| | | | |
|---|---|---|---|
| 2,070,444 | 2/1937 | Mikaelson et al. | 242/78.8 |
| 2,318,320 | 5/1943 | McFadden | 242/78.7 |
| 2,321,486 | 6/1943 | Holt | 248/669 |
| 2,746,511 | 5/1956 | Branthoover | 242/78.7 |
| 2,887,147 | 5/1959 | Ficht | 242/78.8 |
| 3,239,169 | 3/1966 | Sloyan | 248/656 |

FOREIGN PATENT DOCUMENTS

| | | | |
|---|---|---|---|
| 2426 | 1/1976 | Japan | 242/78.8 |
| 480471 | 8/1975 | U.S.S.R. | 72/183 |

*Primary Examiner*—Lowell A. Larson

*Attorney, Agent, or Firm*—Harness, Dickey & Pierce

[57] ABSTRACT

A cradle straightener feeder for feeding sheet metal to an accessory unit comprising a bottom payoff cradle feeder, driving the coil at the outer periphery thereof, a straightener feeder having an output which feeds sheet metal to an accessory unit, a mechanism for directing sheet metal from the cradle feeder to the straightener feeder, and a mechanism for cross-feeding said sheet metal to said accessory unit which may cross-feed the sheet metal simultaneously with the forward feeding of the output of the straightener feeder. The directing mechanism may include a pivoted threader bar mechanism which is an instrumental part of a loading cushioning mechanism, a coil peeler mechanism and a dekinking or decurling mechanism. The straightener feeder may also include a powered mechanism for adjusting the pass line height of the straightener feeder to the correct height needed for a selected accessory unit.

11 Claims, 6 Drawing Figures

FIG. 5.
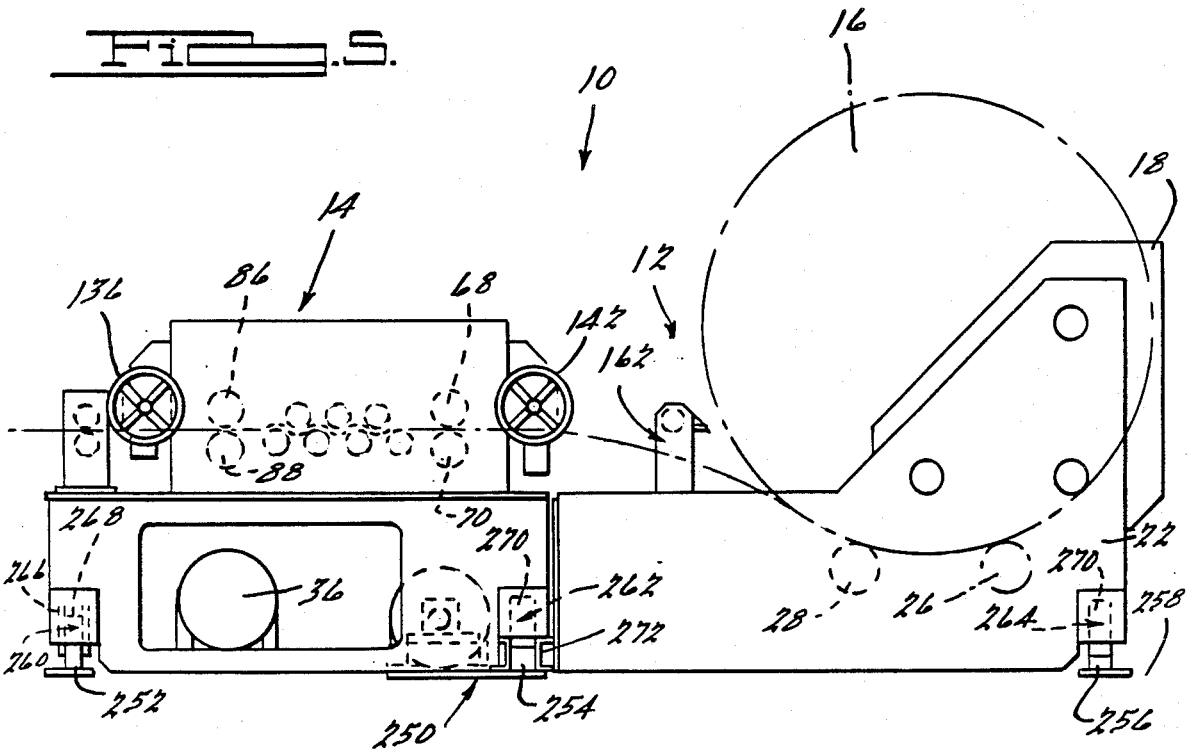
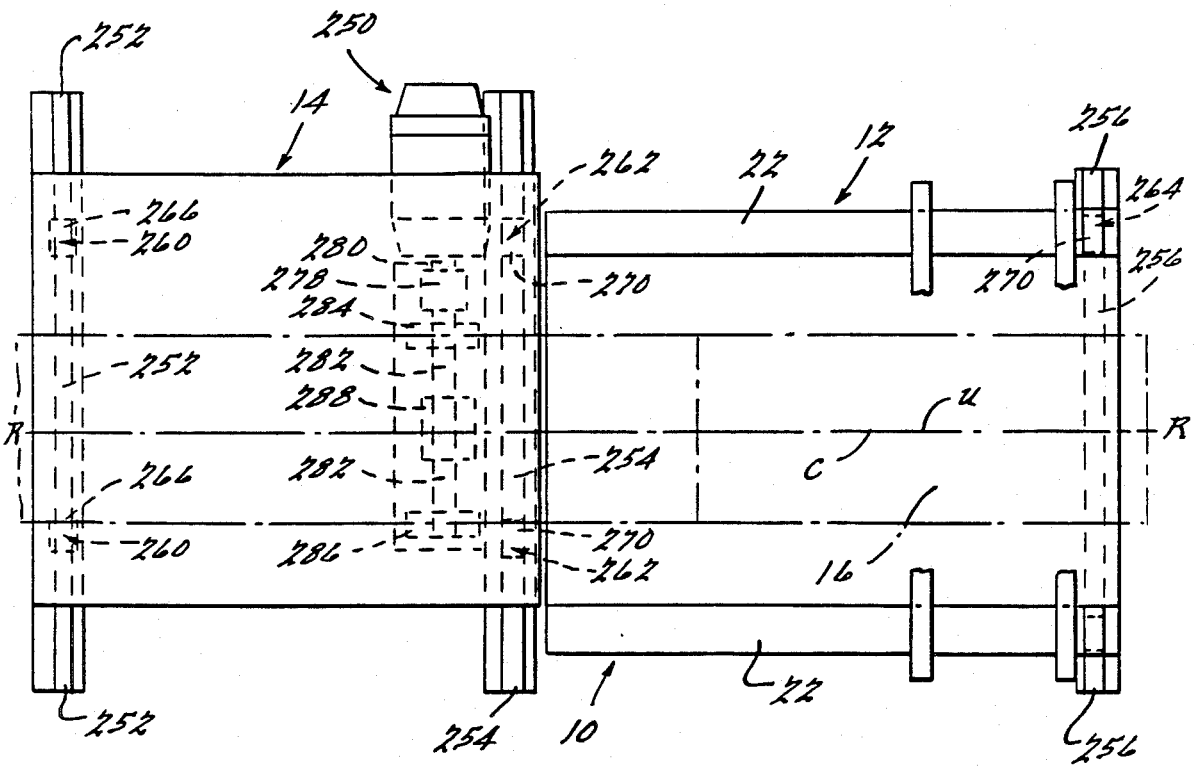
FIG. 6.

CRADLE STRAIGHTENER FEEDER

This is a continuation of application Ser. No. 323,830, filed Nov. 23, 1981, now U.S. Pat. No. 4,487,045 granted Dec. 11, 1984.

BACKGROUND AND SUMMARY OF THE INVENTION

The present invention relates generally to sheet metal feed mechanisms and particularly to a cradle straightener feeder for heavy gauge and high-strength sheet steel.

Prior art sheet metal feeder mechanisms utilize a coil of sheet metal mounted on a powered spindle having a coil hold-down roll and need a second motorized hold-down roll for traction. Traditional coil loading and threading devices have top feed uncoilers, powered coil hold-down rolls, a powered coil cushioning device, an extendable peeler, and a powered dekinker or decurler. These devices, however, have required on the order of thirty to thirty-five discrete operator sequence events to load and commence operation of the device, each of which events usually require approximately thirty seconds per event. Some of the operator sequence events have to be repeated two or more times to accommodate coil-to-coil mechanical variations. The present invention eliminates at least five distinct conventional operator sequence events per coil change at the time of coil change, with a reasonable expectation of time savings of at least two-and-a-half minutes per coil change and often a time savings of five or more minutes per coil change, such as the extension and retraction of a separate coil cushioning device, extension and retraction of a separate extensible peeler (plus the positioning of the peeler), and moving a separate, powered dekinker or decurler apparatus upwardly and downwardly. The present invention is generally loaded and commencing operation in at most fifteen operator sequence events, with many of the traditional steps and apparatus integrated into the novel constructions of the present invention.

The present invention also has an object of utilizing the weight of a coil to act as an advantage in a cradle feeder by using bottom of coil payoff, eliminating the necessity of having a coil hold-down roll and any redundant second motorized hold-down rotation roll for traction. A further object is to use the forces in the coil to cause the outer wrap of the coil to break away from the outside diameter of the coil. A further object is to control the position of this break away event by positioning the leading edge of the coil at a desirable point relative to the lower outgoing driven cradle roll so that only that portion of the outer coil wrap will spring away from the coil outside diameter, and only at a controlled and desired time.

It is an additional object of the present invention to have the leading edge of the coil being threaded always visible to the operator from the outside diameter of the coil to at least the input pinch rollers of the combination straightener feeder.

A series of advantages of the present invention further evolve from the use of a powered pivoting threader bar and roller to provide several different functions. The bar may direct the leading edge of the coil toward the entry pinch rollers of the straightener feeder and control the leading edge of the coil over a coil curvature removal roller, thereby flattening the leading edge for acceptance into the input pinch rollers of the straightener. The threader bar can also act as a coil containment device which in most cases will eliminate the common practice of containing a coil by putting a bar through the inside diameter of the coil and into anchor slots or holes in either the side plate, machine frame, or both. Also, the threader bar in combination with the removal roller can be employed to decurl the trailing end of a coil roll for easier acceptance by the input rolls of the straightener and preclude a double coil thickness from being rolled over and pulled into the straightener with the attendant possibility of substantial damage and down time. The threader bar also may act as a coil cushion stop to protect the cradle roll bearings from impact shock during loading due to the coil rolling into the cradle from a coil storage and feeding ramp or other loading mechanism.

The present invention also has the object of providing adjustable straightener feeder pass line height adjustment to be capable of using the straightener feeder with any height compatible with a desired accessory unit, such as a shear and stacking unit, a conveyor, a press, or whatever selected accessory unit into which the sheet metal from the coil is fed.

Within the cradle holding the coil, the present invention has the object of providing adjustable cradle side plate coil guides. With both side plates adjustable, accommodations may be made for variations in coil width and assuring proper alignment with any selected compatible accessory unit.

A further object of the present invention is to incorporate a variable speed and variable torque main power transmission gear box. Such an arrangement enables the feed capacity of the unit to be greatly increased with regard to additional thickness, material strength, or width increases of the sheet metal in the coil over a standard geared unit. Such a unit can be cost-effective and desireable even with the speed sacrifice that may result as a trade-off when the variable torque gear box variation of the present invention is selected.

The cradle area also has the object of providing a protective finish, lubrication, or other desired liquid coating to the sheet metal coil via a roller coater incorporated within the cradle drive mechanism for the sheet metal coil. A protective coating may be utilized, for example, when an interface for protecting more critically finished materials is desired.

The present invention has the further object of creating a relationship of straightener rollers to the pass line of the material that requires a low bend rate with regard to the coil of material being fed. The present invention, with its low bend rate, does not require the steel to reach its yield point in order to pass into the straightener area of the machine where it is worked prior to feeding to an accessory unit. Also, low energy requirements exist due to the geometry of the cradle roll with regard to the straightener rollers to provide a significant cost savings when compared to prior art devices. Generally, the present invention drives the coil with a controlled acceleration, deceleration and velocity formulating an accurate feed progression with non-accumulating error.

The input pinch rollers and output feed rollers of the present invention also have a protective feature in case a curled trailing end of the coil reaches the pinch or feed rollers without the machine successfully decurling the trailing end or if a wide variation might exist in a sheet metal coil, which variation might damage the pinch or feed rollers. A cross-over check relief valve attached to a hydraulic cylinder mechanism which also provides an operating force to the pinch and feed rollers permits the upper pinch roller or upper feed roller to be jogged upwardly out of engagement with the main body of the sheet metal fed into the straightener feeder. Such a protective feature prevents damage to the pinch or feed rollers from double thickness material being inadvertently fed into the straightener feeder.

Essentially then, the present invention offers a compact, cost-effective mechanism enabling coil automation in the press shop without costly plant rearrangement, particularly in not requiring relocation or use of pit mounted presses. Units of the present invention can reduce the floor space requirements by seventy-five percent compared to traditional installations. A typical unit of the present invention will be somewhat less than three times the maximum coil diameter in length and approximately twice the maximum coil width in its width.

The present invention is designed to accommodate a broad range of metal thicknesses, widths and velocities with certain special operator conveniences, facilitating rapid loading and threading of new coils through the device and into the accessory application.

The present invention takes a lot less space, does not require a pit, is one unit (no alignment problems), is easy to align and install, and is extremely simple to operate. The simplicity is essentially due to the fact that fewer moving parts exist than conventional units (providing fewer and simpler operator controls with equal or greater levels of sophistication), the operator's view of many of the essential functions is unobstructed, and the present invention provides the shortest automated coil-threading path of any comparable system in the industry.

The present invention has an even further object of providing a joggle feeding mechanism to simultaneously feed forwardly and cross feed laterally. The joggle feed has the advantage of economy in material cost by feeding a single station blank die press or other similar single station accessory unit in a manner that results in a double die configuration producing much less scrap material. This is particularly useful when feeding heavy gauge material where the flexibility of movement of the material itself is minimal.

Other objects and advantages of the instant invention will be apparent in the following specification, claims and drawings.

BRIEF DESCRIPTION OF THE DRAWINGS

FIG. 5 is a side elevational view of an alternative embodiment of a cradle straightener feeder of the present invention; and FIG. 6 is an elevational plan view of the feeder illustrated in FIG. 5.

DETAILED DESCRIPTION OF THE PREFERRED EMBODIMENTS

Figure 1:
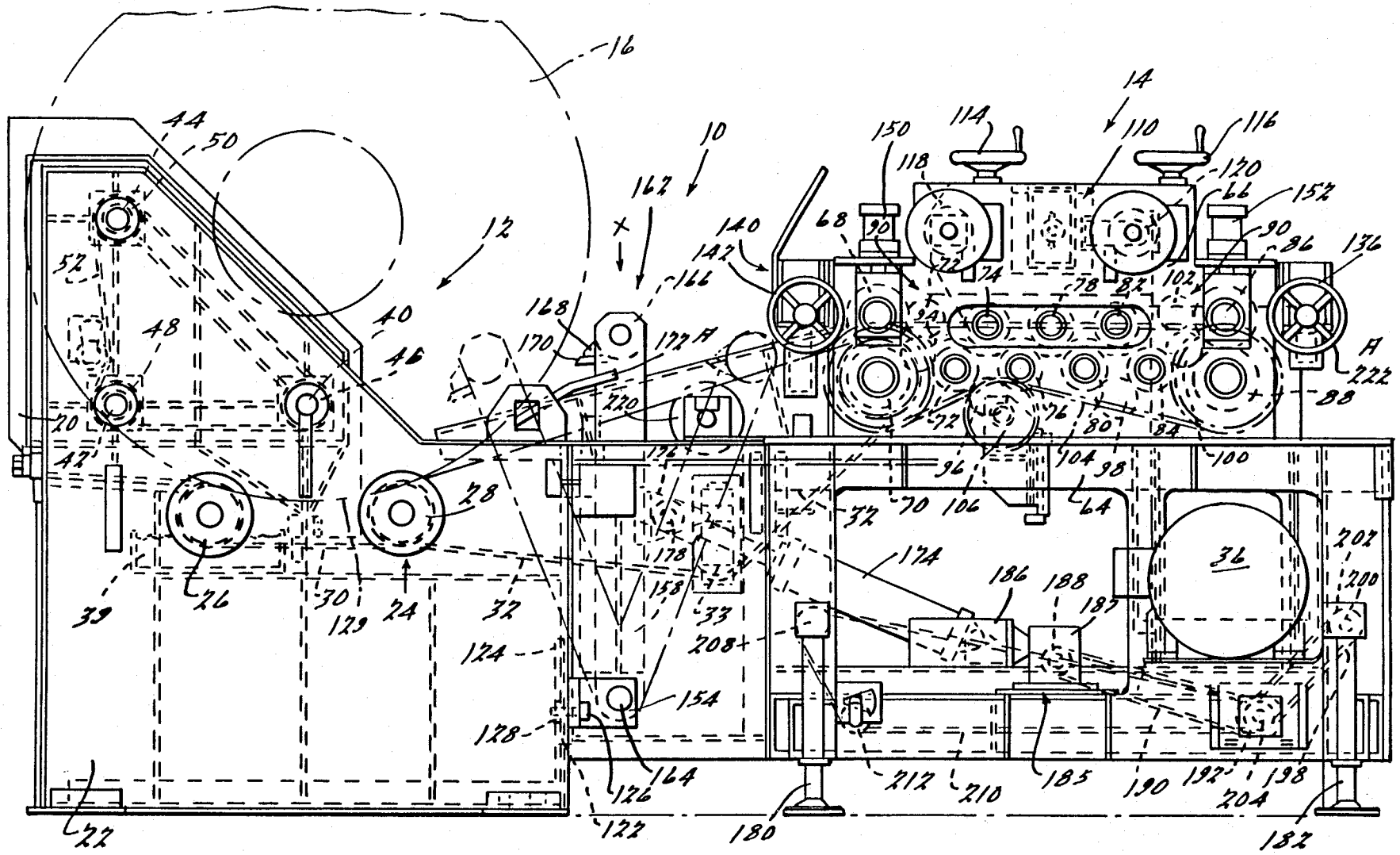
FIG. 1 is a side elevational view of a mechanism of the present invention.
Figure 2:
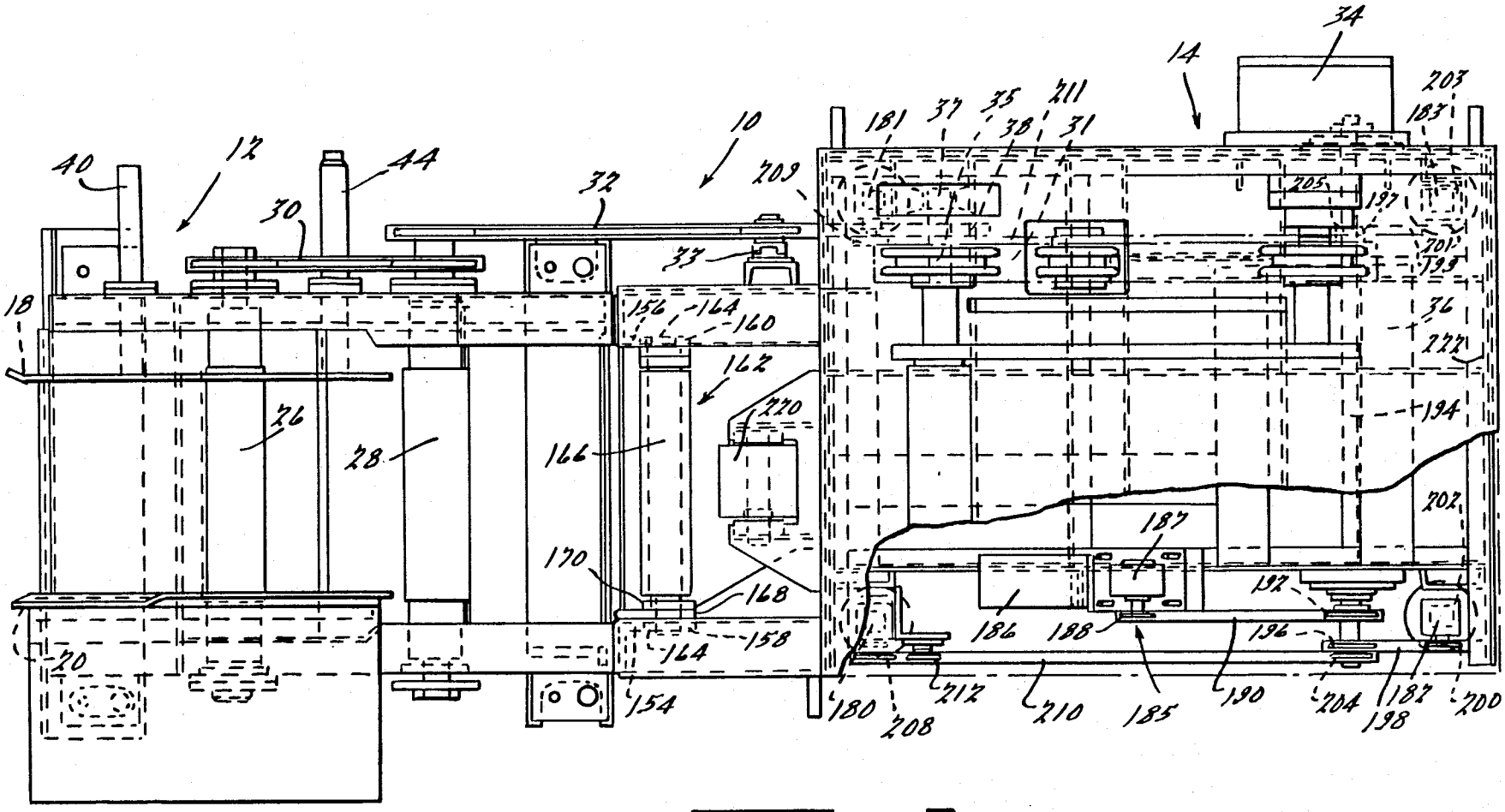
FIG. 2 is a plan elevational view illustrating the present invention.

Referring to FIGS. 1 and 2, a cradle feeder straightener 10 is illustrated having a cradle feeder mechanism 12 for a coil of sheet metal operably associated with a straightener feeder 14 into which the sheet metal coil 16 is fed. The cradle 12 consists of a pair of sidewalls 18 and 20 mounted on base portion 22 and laterally adjustable towards and away from one another to permit various widths of coils to be fed with the added option of feeding along the centerline of the cradle feeder 12 or off of the centerline of the feeder 12. A cradle feeder drive mechanism 24 is disposed below the coil 16 when the coil is situated in the cradle 12 and comprises a pair of drive rollers 26 and 28 linked together via a chain 30. Drive roller 28 is driven via a powered drive chain 32 (FIG. 2). The elements driving the chain 32 will be described below. A chain tightener 33 is also included for the chain 32.

The first drive roller 26 is operably disposed in contact with a bath 39 of liquid which may comprise a lubricant, a detergent, a protective coating, or other liquid which may be desirably coated onto the outside surface of the sheet metal in the sheet metal coil 16. A protective coating may be utilized, for example, when an interface for protecting more critically finished sheet metal materials is desired. Other liquids may be used as desired to respond to particular problems or protect against the possibility of such problems occurring if any are encountered as a consequence of using a particular material and/or using the accessory apparatus (press; shear and stacking unit; etc.) to which the straightener feeder 14 is presenting the sheet metal. The protective coating may also be gelatinous or solid as desired if compatible with the bath 39 and coater roller 26 construction.

Sidewalls 18 and 20 operate independently in an identical manner. For purposes of conciseness, the operating mechanism controlling sidewall 20 has been omitted and details will be presented here only with regard to the operation of sidewall 18. It is intended, however, that the mechanism described with regard to controlling sidewall 18 be equally applicable to controlling sidewall 20 as secured to an opposed portion of the upper section of base portion 22.

Sidewall 18 is secured to an upper section of the base portion 22 by means of three threaded rods 40, 42, and 44. Rod 40 is rotatable and is fixedly secured to a collar 46 which is operably associated with two other collars 48 and 50 via a drive belt 52 (FIG. 1). Collars 48 and 50 are threadably associated with rods 42 and 44. As rod 40 is rotated, collars 48 and 50 are rotated to threadably engage and axially move rods 42 and 44 in one of two axial directions and move the sidewall in the same axial direction. Sidewall 20 may optionally have a similar adjustment, in which case the centerline of the coil stock may be varied with respect to the centerline of the cradle 12 or the cradle 12 centerline may be maintained as the centerline of the coil stock.

The straightener feeder 14 essentially comprises a base portion 64 and a roller portion 66 disposed on the base portion 64. The roller portion 66 is comprised of two 8 inch hardened Crodan finished input pinch rollers 68 and 70, seven 5⅝ inch hardened and ground straightening rollers (mounted three on top and four on the bottom) 72, 74, 76, 78, 80, 82, and 84, and two 8 inch hardened Crodan finished output feed rollers 86 and 88.

Figure 3:
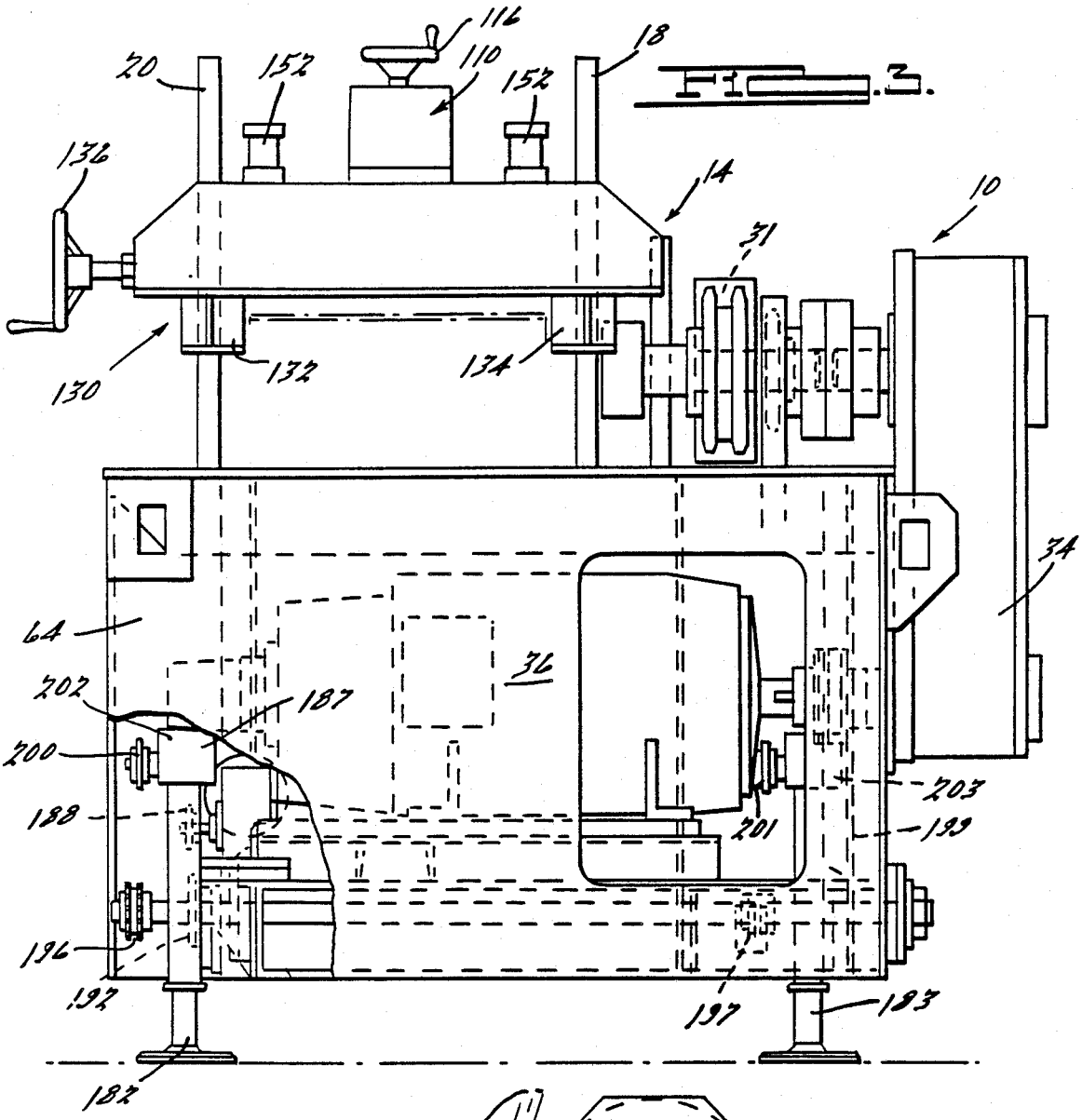
FIG. 3 is a front elevational view looking in the direction of lines 3, 3 of above FIG. 1.

All the rollers are mounted in anti-friction bearings. The lower input pinch roller 70, the lower output feed roller 88, the lower straightening rollers 72, 76, 80, and 84, upper pinch roller 68, and upper feed roller 86 are interconnected by gearing 90 (FIG. 3), as illustrated by gears 92, 94, 96, 98, 100, and 102.

Lower output feed roller 88 is driven by a drive motor 36 via a gearbox 34. A drive chain 104 drivingly connects lower output feed roller 88 with input pinch roller 70. The gearbox 34 preferably comprises a set of precision gears with zero backlash couplings and minimum ratio, minimum backlash precision gears. All of the gearing in the gearbox 34 is run in oil. A chain tightener 106 is also included in the assembly and is operably associated with chain 104.

Thus, drive motor 36 via gearbox 34 drives lower output feed roller 88, which drives lower input pinch roller 70 via chain 104 and sprocket 35. Lower input pinch roller 70 in turn drives sprocket 38 via shaft 37 to drive chain 32 and, thereby, the cradle feeder drive mechanism 24. Lower rollers 70 and 88 also drive through gearing 90, both upper pinch rollers 68 and 86 and lower straightener rollers 72, 76, 80, and 84.

The position of the upper straightener rollers 74, 78, and 82 is determined by a control mechanism 110 comprising a bank 112 holding the rollers 74, 78, and 82 in a fixed position relative to one another. The bank is manually controlled by controls 114 and 116 which each operably adjust a respective eccentric mechanism 118 and 120 to set the position of the upper rollers 74, 78, and 82 with respect to the lower rollers 72, 76, 80, and 84. Gauges (not shown) may also be operably disposed on the side of the mechanism 110 and operably associated with eccentric mechanisms 118 and 120 to indicate the setting for the material thickness that is desired to pass through the straightener feeder 14. The straightener feeder 14 may optionally have only five straightener rollers in a less costly assembly, if so desired.

The base portion 22 of the cradle feeder 12 may be secured to and aligned with the straightener feeder 14 by means of elongated vertically extending keys 122 integrally associated with the straightener 14 and disposed in keyways 124 set in the base portion 22 of the feeder 12. Securement bolts 126 are disposed in slots (not shown) in the base portion 64 of the straightener feeder 14 and are threadably inserted into threaded nuts 128 disposed in the base portion 22 of the cradle feeder 12.

It should also be noted here that the geometry of the pass line A (FIG. 1) from the cradle feeder 12 to the input pinch rollers 68 and 70 of the straightener feeder 14 illustrates the pass line A to be only slightly elevated from the lowest point 129 from which sheet metal is fed to the input pinch rollers 68 and 70. Thus, the present invention requires a very low bend rate and does not require the steel to reach its yield point to pass into the straightener area of the machine. The geometry of the present invention also requires a low energy requirement compared to prior art units, some of which pass the sheet metal seven to ten feet upwardly at one point of its operation.

As the material passes rollers 72 to 84, it is worked due to the wavy path the material traverses between the offset positions of the rollers 72–84. The output feed rollers 86 and 88 feed the material to the accessory unit in a worked form.

Width adjustments relative to the stock centerline and the centerline of the accessory unit to the straightener feeder 14 can be made via control mechanism 130 (FIG. 3) which has guides 132 and 134 laterally movable by a manual wheel control 136 threadably engaged to move the guides from side-to-side either jointly or separately. A similar control mechanism 140 is set at the entry point of the straightener feeder 14 and controlled by manual wheel control 142 (FIG. 1).

The control mechanism 110 for the straightener feeder 14 also includes hydraulic mechanisms 150 and 152 to apply downward hydraulic pressure on the upper pinch rollers 68 and 86, respectively, against the lower pinch rollers 70 and 88 and/or the material. The hydraulic cylinders will maintain downward pressure on the pinch rollers 68 and 86 while sheet metal is being fed through the straightener feeder 14. If a double thickness of sheet metal, such as a rolled over trailing end or leading end of a sheet metal roll, is encountered by the upper pinch rollers 68 or 86, the pinch roller will be released upwardly by the cylinder via a cross-over check relief valve (not shown) to accommodate the double thickness and not damage the pinch rollers. The straightener rollers 72–84 will not be damaged by the turned up end of the sheet metal, and will continue to work the metal, due to the longitudinally offset position of the rollers which allows for clearance of such a double thickness.

Figure 4:
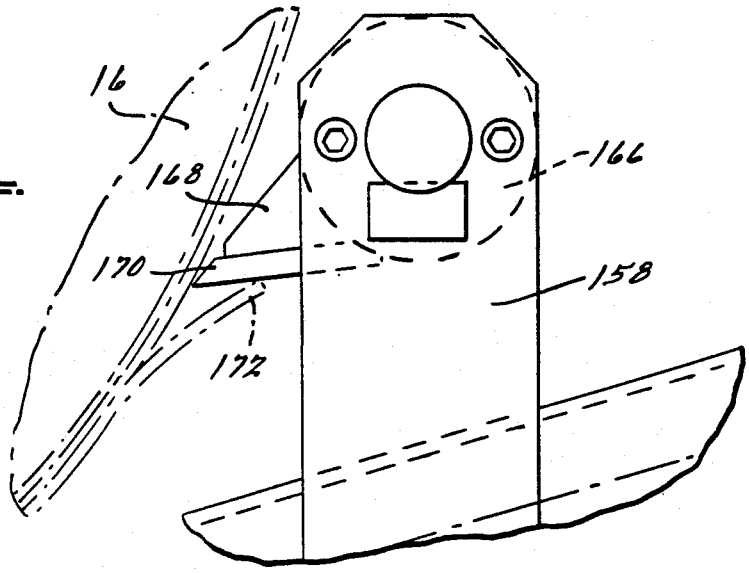
FIG. 4 is an enlarged elevational view of the threader bar and coil interface portion of FIG. 1.

The straightener feeder 14 also includes lugs 154 and 156 with which arms 158 and 160 of a pivoted H-shaped threader arm mechanism 162 are operably associated via pins 164. Between the arms 158 and 160 is disposed a roller 166. Disposed between arms 158 and 160 and the roller 166 is a peeler 168, having a knife edge 170 (FIGS. 1 and 4).

In most cases, the coil 16 of sheet metal will have the natural spring outwardly for its leading edge once the circumferential belly band is cut. In those cases where the natural spring is reversed, the peeler 168 can be located adjacent the coil 16 to force out the leading edge 172 of the coil 16 to commence the feeding operation into the straightener feeder (FIG. 4). The threader arm mechanism 162 is controlled via a hydraulic cylinder 174 and a control mechanism therefor (not shown). The hydraulic cylinder is secured to the base portion 64 of the straightener feeder 14, and is also secured to the threader arm mechanism 162 via clevis 176 and pin 178.

The straightener feeder also has another significant feature in providing a height adjustment of the pass line A of the sheet metal through the straightener feeder 14. The pass line height can be adjusted to fit any of a number of various accessory units to which the straightener feeder 14 will feed. The straightener feeder 14 sits on four legs, 180, 181, 182, and 183. The position of the legs (height of the straightener feeder 14) is simultaneously controlled for all four legs via a gear motor 185 which includes a control mechanism (not shown), an electric motor 186, gear box 187 and drive sprocket 188 connected via a drive chain 190 to a transfer sprocket 192. Transfer sprocket 192 is attached to a shaft 194 to which a pair of second drive sprockets 196, 197 are attached one on each end thereof. Second drive sprockets 196, 197 are linked via drive chains 198 and 199 with leg drive sprockets 200, 201 for legs 182 and 183. Leg drive sprockets 200 and 201 are linked to legs 182 and 183 respectively via screw jacks 202 and 203 which translate the rotary motion of the drive sprockets 200, 201 into axial motion upwardly of the legs 182 and 183.

Similarly, transfer sprocket 192 also drives shaft 194 to drive two second transfer sprockets 204 and 205. The second transfer sprockets 204 and 205 in turn drive leg drive sprockets 208 and 209, respectively, via drive chains 210 and 211, respectively, which each include a chain tightener 212. Leg drive sprockets 208 and 209 are linked via screw jacks 214 and 215 to legs 180 and 181 to translate the rotary movement of the drive sprockets 208 and 209 into axial movement of the legs 180 and 181.

Commencement of the drive motor 187 will either raise or lower the pass line height of the straightener feeder 14 as selectively desired by the operator to match the accessory to which the straightener feeder is feeding.

Thus the operator first measures the coil for width and thickness. The side guides 18 and 20 of the cradle feeder 12 are adjusted to match the width of the coil 16 and similarly the guides 132 and 134 of the straightener feeder 14 (FIG. 4) are also adjusted to this dimension. The operator then attaches the appropriate accessory unit (such as a press) and aligns the pass line height of the accessory unit to the straightener feeder 14. Then the operator adjusts the desired output of the straightener feeder 14 with the accessory unit by adjusting the stock guides 132 and 134 via the control mechanism 130. The straightener rollers 72–84 are set based on the thickness of the sheet metal in the coil 16 via the control mechanism 110 and manual controls 114 and 116. The threader arm mechanism 162 is pivoted to a loading position. The coil 16 is then placed in the cradle feeder 12 either directly or indirectly via a ramp loader, crane, etc., and is cushioned by the threader bar roller 166. The bar 166 is disposed at this stage in abutting relationship with the outside diameter of the coil (substantially as shown by position X, FIG. 1). The coil 16 is rotatably advanced forwardly, while the circumferential belly band is still attached, until the leading edge 172 is just above the threader bar roller 166. The belly band is then cut.

The coil is rewound by reversing the drive mechanism 24 until the leading edge is just below the threader bar roller 166. At this point, the threader bar roller 166 is in contact with the coil 16 at a position substantially below the rotational axis of the coil 16. The coil 16 is advanced by the drive mechanism 24 so that the leading edge 172 goes under the threader bar roller 166, optionally aided as needed by the peeler 168. The leading edge 172 is peeled off of the coil 16 in a direction tangential to the movement of the threader bar mechanism 162. The coil leading edge 172 is advanced further, along with an advance of the threader bar mechanism 162, in a manner that the leading edge stays approximately four inches ahead of the travel of the threader bar roller 166. As the threader bar 166 moves from the cradle feeder 12 to the straightener feeder 14, the threader bar 166 maintains a position below the rotational axis of the coil 16. The threader bar roller 166 then bends the sheet metal from the coil 16 around a roller 220 mounted to the base portion 64 of the straightener feeder 14 just below the travel of the threader arm roller 166. At this point, the leading edge 172 of the coil 16 is ready to be advanced into the input pinch rollers 68 and 70. The operator hydraulically closes the input pinch rollers 68 and 70 and activates the drive motor 36 to pull the leading edge of the coil 16 through the input pinch rollers 68 and 70, then through the straightener rollers 72–84 in a wave pattern between the rollers (to work the material). The material then passes through the output feed rollers 86 and 88, to the output 222 of the straightener feeder, and into the accessory unit into which the sheet metal is fed. The operator generally will start a few operations of the accessory unit at a slow rate to make sure operating conditions are as desired and then will adjust the rate. The rate at which the sheet metal is fed into the accessory unit can be adjusted at any time.

If the accessory unit is a press, the drive mechanism 24 of the cradle feeder 12 may be indexed on the upstroke of the press to any desired dimension of the stroke and this rate may be adjusted at any time. Typical operations of the unit with the press are one hundred strokes per minute at a feed of three inches or fifteen strokes per minute at a feed of ten feet. Indexing typically is performed at 270 degrees of the press stroke. The feed progression rate may be varied at any time by varying the velocity of the motor 36. The material and the coil 16 move throughout the entire operation with controlled acceleration, velocity, and deceleration. The embodiment illustrated is typically used with a variable speed, constant torque gearbox. It is believed that an optional variable speed, variable torque gearbox may also be readily incorporated into the drive mechanism 34 to accommodate various thicknesses of material with the same desired torque, with a trade-off of lower speed at some settings.

Drive mechanism 24 also notably may reverse the coil anytime that a desired number of parts has been manufactured and wherein further manufacture is not desired. The operator may reverse the drive mechanism 24 to rewind the coil to a position where a circumferential belly band may be attached to it and have the remainder of the coil 16 removed from the cradle 12.

The feeder unit 10 also is very readily amendable to a central lubrication system, with fault indication and interlocks as optional accessories.

As a further alternative a joggle feed mechanism 250 (FIGS. 5 and 6) may be incorporated within the above described cradle straightener feeder 10 for greater economy in material cost by feeding an accessory unit, such as a single station blank die press in a double die material saving configuration, to produce much less scrap material. The joggle feed mechanism 250 provides a lateral cross feed of the stock material simultaneous with the forward feed from the cradle straightener feeder unit 10. The joggle feed mechanism 250 can be activated to index in response to the same cue or operation as the forward feed, which is typically at 270 degrees of the press stroke, as described above.

The joggle feed mechanism 250 moes the entire cradle straightener feeder 10 side-to-side as a single unit. Three tracks 252, 254 and 256 are fixedly disposed in parallel on a base member or the floor of the plant 258 so that the two outer tracks 252 and 256 are substantially disposed at the longitudinal extremes of the unit 10 and track 254 is disposed at an intermediate location between the other two tracks 252, 256, preferably adjacent the point of interface between the cradle feeder 12 and the straightener feeder 14.

The feeder unit 10 has sets of wheels 260, 262, and 264 disposed at longitudinally spaced locations of the unit 10 corresponding to the positions of the tracks 252, 254 and 256. Each wheel 266 of the set of wheels 260 has a guide groove 268 which permits each wheel 266 to ride on the corresponding track 252. Wheels 270 of sets of wheels 262 and 264 have smooth configuration allowing them to ride on top of the respective tracks 254 and 256, but may, in the alternative also have a guide groove, as desired. The unit 10 has a gib 272 secured thereto at the base of the intermediate position 274 thereof. The gib 272 has a lateral dimension corresponding to the lateral dimension of the track 254 to act as a guide member for the set of wheels 262 and unit 10 with respect to the intermediate track 254. Again, the gib 272 arrangement may be utilized with any of the sets of wheels 260, 262 and 264, as desired.

With reference to FIG. 6, the cross feeding of the joggle feed mechanism 250 has a control mechanism (not shown) digitally controlling a direct current elective motor 276. A coupling 278 secures the drive shaft 280 of the motor 276 to a drive screw 282 rotatably disposed in bearings 284 and 286. A collar 288 is fixedly secured to the cradle straightener feeder unit 10 and has a threaded internal bore threadably associated with the drive screw 282 to be driven thereby to reciprocate the unit 10 side-to-side as the direction of the motor 276 alternated. Alternatively, a rack and pinion arrangement may be used to reciprocate the unit 10.

The joggle mechanism 250 will move the coil 16 on the feed unit 10 as an entire unit, moving the longitudinal centerline of the unit 10 or the longitudinal centerline C of the coil from side-to-side of a reference line R-R parallel to the longitudinal centerline U of the unit 10 or the longitudinal centerline C of the coil. The reference line R-R is usually the line formed by the centerline U of the unit 10 when the unit 10 feeds the sheet metal forwardly without any cross-feeding by the joggle feeding mechanism 250 (in FIG. 6, the centerline C of the coil 16 and centerline U of the unit 10 are identical, but may be offset, as described above). The mechanism 250 is particularly useful when feeding heavy gauge material where the flexibility of movement of the material itself is minimal. One example of the drive screw 282/collar 288 relationship will be one-half inch of machine movement per motor 276 revolution. The unit 10 (and collar 288) will move from one extreme end 298 of the drive screw 282 to the other extreme end 292 of the drive screw 282, a typical distance of approximately fifteen inches, in typically approximately three to five seconds (whatever time would match the forward feed rate of the unit 10). The forward feed and lateral cross feed usually are simultaneous, resulting in high rates of cycles per minute.

Thus, there is disclosed in the above description and in the drawings an improved cradle straightener feeder which fully and effectively accomplishes the objects outlined above. Any dimensions or times set forth in the above specification are merely representative and are not meant to be limiting on the scope of the invention. It will be apparent that variations and modifications of the disclosed embodiments may be made without departing from the principles of the invention or the scope of the appended claims.

We claim:

1. An apparatus for feeding a coil of sheet metal to an accessory unit, comprising:

cradle means for holding said coil in a selected position, including drive means for rotating said coil, said drive mens rotating said coil of sheet metal around a rotational axis to feed said sheet metal out of said cradle means, said drive means contacting said coil solely at the outside periphery of said coil and feeding said coil from below the rotational axis of said coil wherein said sheet metal traveling out of said cradle means does not need to travel above a substantially horizontal plane which includes the pass line of said straightener means;

straightener means for feeding said sheet metal to said accessory unit, having input means and output means, said input means including a pair of pinch rollers comprising an upper pinch roller and a lower pinch roller and said output means including a pair of feed rollers comprising an upper feed roller and a lower feed roller, said straightener means including hydraulic means for applying pressure to said upper input pinch roller and upper output feed roller, said hydraulic means including a first means for applying a first selected pressure to said upper pinch roller and a second means for applying a second selected pressure to said upper feed roller throughout the length of the sheet metal fed through said straightener means and means for substantially completely releasing said upper input pinch roller and upper output feed roller, comprising relief valve means, in response to undesirable thicknesses of metal passing between said input means pinch rollers or said output means feed rollers; and means for directing said sheet metal from said cradle means to said input means of said straightener means said directing means comprising;

pivotally mounted means for directing said sheet metal from said cradle means to said straightener means, said pivotally mounted means having a means for contacting said sheet metal, said contacting means contacting said sheet metal once said sheet metal is released from said coil, said sheet metal traveling from said cradle to said straightener means in substantially all conditions of size of said coil does not intersect the horizontal plane associated with the current position of the rotational axis of said coil at any time from the release of the sheet metal from the coil directed to said straightener means until the sheet metal enters said straightener means and through the straightener means into an accessory unit, wherein the amount of bending of said sheet metal passing through said directing means from said cradle means to said straightener means is substantially less than the bending required to force said sheet metal to the yield point of the metal material, said contacting means having a member for peeling the leading edge of said sheet metal coil away from the outside periphery of said coil in a direction tangential to the movement of said directing means and said directing means having a pivot point wherein said sheet metal is disposed between said contacting means and said pivot point as the sheet metal travels from said cradle means to said straightener means.

2. An apparatus in accordance with claim 1, wherein said drive means further comprises a bath and a pair of drive rollers, at least one of said drive rollers being a coater roller operably associated with both said bath and said outside periphery of said coil.

3. An apparatus in accordance with claim 2, wherein said bath is a liquid lubricant.

4. An apparatus in accordance with claim 2, wherein said bath is a liquid protective finish.

5. An apparatus in accordance with claim 2, wherein said bath is a gelatinous lubricant.

6. An apparatus in accordance with claim 1, wherein said peeler member is solely moveable with said bar.

7. An apparatus in accordance with claim 1, wherein said unit further comprises means for decurling said sheet metal operably associated with said pivotally mounted means.

8. An apparatus in accordance with claim 7, wherein said means for decurling comprises a stationary roller capable of acting together with said pivotally mounted means to decurl the leading or trailing edges of said sheet metal as said sheet metal is fed from said coil.

9. An apparatus in accordance with claim 1, further comprising gear box means for said drive means capable of varying the speed and torque as desired in a selected operation.

10. The apparatus in accordance with claim 34 wherein said straightener means including powered means for adjusting the height of said pass line at said output means comprising at least one leg upon which said straightener means is disposed, motor means, drive sprocket means secured to said motor means, leg drive means for raising or lowering each said leg disposed at each said leg, and means for operably associating said drive sprocket means with said leg drive means to raise or lower the pass line height in response to movement of said motor means.

11. An apparatus in accordance with claim 10, wherein said powered adjusting means further comprises four legs upon which said straightener means is disposed, each having operably associated leg drive means, and said motor means further comprises a gear box means for controlling said motor means and the pass line height of the straightener means.

* * * * *